US007870774B2

(12) United States Patent
Hasegawa et al.

(10) Patent No.: US 7,870,774 B2
(45) Date of Patent: Jan. 18, 2011

(54) ROLLER HEMMING APPARATUS AND ROLLER HEMMING METHOD

(75) Inventors: Eisaku Hasegawa, Tochigi (JP); Yoshiyuki Kinouchi, Tochigi (JP); Takeshi Nakamura, Tochigi (JP); Noriko Uematsu, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 473 days.

(21) Appl. No.: 11/993,510

(22) PCT Filed: Jun. 22, 2006

(86) PCT No.: PCT/JP2006/312471

§ 371 (c)(1),
(2), (4) Date: Dec. 21, 2007

(87) PCT Pub. No.: WO2006/137467

PCT Pub. Date: Dec. 28, 2006

(65) Prior Publication Data

US 2010/0154503 A1 Jun. 24, 2010

(30) Foreign Application Priority Data

Jun. 22, 2005 (JP) ..... 2005-182525

(51) Int. Cl.
*B21D 7/02* (2006.01)

(52) U.S. Cl. ..... 72/220; 72/306; 72/316; 72/322

(58) Field of Classification Search ..... 72/110, 72/111, 124, 125, 214, 220, 306, 296, 300, 72/316, 322; 29/243.57, 243.58
See application file for complete search history.

(56) References Cited

U.S. PATENT DOCUMENTS

| | | | | |
|---|---|---|---|---|
| 5,228,190 | A * | 7/1993 | Sawa | 29/715 |
| 7,124,611 | B2 * | 10/2006 | Baulier et al. | 72/220 |
| 7,134,309 | B2 * | 11/2006 | Toeniskoetter | 72/306 |
| 7,152,447 | B2 * | 12/2006 | Toeniskoetter | 72/214 |

FOREIGN PATENT DOCUMENTS

| | | | |
|---|---|---|---|
| DE | 60300614 | | 12/2005 |
| EP | 1447155 | | 5/2005 |
| JP | 5-023763 | | 2/1993 |
| JP | 5-23763 | * | 2/1993 |
| JP | 5-050161 | | 3/1993 |
| JP | 6-344037 | * | 6/1993 |
| JP | 6-344037 | | 12/1994 |
| JP | 7-016731 | | 3/1995 |
| JP | 7-68324 | * | 3/1995 |

* cited by examiner

*Primary Examiner*—Edward Tolan
(74) *Attorney, Agent, or Firm*—Rankin, Hill & Clark LLP

(57) ABSTRACT

In an initial state of roller hemming processing, an erected flange 65 begins to be bent by a roller 48. At this time, a first plate 63 and a receiving face 15 are brought into tightly contact with each other at a contact point 70 between the roller 48 and the erected flange 65 by strongly pinching by the roller 48 and an auxiliary roller 51. On the other hand, in portions other than the contact point 70, the receiving face 15 tends to be separated from the first plate 63 by reaction. Since slider blocks 22 and 22 are movable along rails 21 and 21 on a side of the receiving die 10, the receiving die 10 rotates clockwise in the drawing about the contact point 70. A tight contact in the contact point 70 is guaranteed as the receiving die 10 rotates about the contact point 70. As a result, the hemming processing with a good shape can be achieved without wrinkling, ruffling, or deformation.

5 Claims, 19 Drawing Sheets

ROLLER HEMMING APPARATUS AND ROLLER HEMMING METHOD

TECHNICAL FIELD

The present invention relates to improvements in a roller hemming technique.

BACKGROUND ART

It is a processing technique which is widely carried out that two plates are overlapped with each other, an edge of one plate is bent on an edge of the other plate, and the edges of the two plates are connected with each other. This technique is called hemming.

Although a press hemming method using a press die is known well as the hemming, a roller hemming method that is another method is also adopted (for example, refer to JP-A-07-016731 (refer to FIGS. 1 and 3)).

JP-B-07-016731 is described on the basis of the following drawings. FIGS. 16(*a*) and 16(*b*) are views illustrating a basic principle of a conventional technique. Referring to FIG. 16(*a*), a workpiece 102 is placed on a hemming die 101, and an edge of the workpiece 102 is pressed down by clamping arms 104 and 104 of clamping mechanisms 103 and 103.

Referring to FIG. 16(*b*), the workpiece 102 is obtained by overlapping a second plate 108 on a first plate 107 having an erected flange 106. Then, the erected flange 106 is bent by a roller 111 provided in a robot arm 110. As a result, the edge (erected flange 106) of the first plate 107 can be wound around the edge of the second plate 108, and connection between the first plate 107 and the second plate 108 can be made.

FIG. 17 is a sectional view taken along the line 17-17 of FIG. 16(*b*), and shows an example in which the workpiece 102 is pressed down by a plurality of clamping arms 104A, 104B, 104C, and 104D. Meanwhile, it is necessary to make a shape of a receiving face 113 of the hemming die 101 to be the same as a shape of the first plate 107. Since the hemming die 101 is a machined part, its accuracy is excellent. On the other hand, the shape of the first plate 107 that is obtained by plastically deforming a blank material varies under the influence of springback, etc.

When the clamping arms 104A, 104B, 104C, and 104D are in an unclamping state, a gap 114 is formed locally. If the clamping arms 104A, 104B, 104C, and 104D are turned into a clamping state, the gap 114 can be made substantially zero, especially by the operation of the clamping arms 104C and 104D.

If the workpiece 102 is a so-called single article, such as a bonnet or a door, the gap 114 can be eliminated by making an arrangement and number of clamping arms proper. In addition, the single article refers to articles of a size to be placed on the hemming die 101.

Next, a case where a workpiece is larger than the single article, that is, a large-sized part that protrudes largely from a hemming die will be discussed. FIGS. 18(*a*) to 18(*d*) are explanatory views when a conventional roller hemming method is applied to a vehicle body. Although the schematic view of the workpiece 120 is shown in FIG. 18(*a*), the workpiece 120 is a white body and is a large-sized structure that is obtained by combining a plurality of panels. FIG. 18(*b*) is an enlarged view of a section B of FIG. 18(*a*), and shows a rear wheel arch 121.

FIG. 18(*c*) is a sectional view taken along the line C-C of FIG. 18(*b*), and shows a state before a second plate 124 is overlapped on a first plate 123 having an erected flange 122, and the erected flange 122 is bent by hemming. FIG. 18(*d*) shows a state after hemming, and shows that the second plate 124 can be combined with the first plate 123 by winding a lower end 122, i.e., an erected flange, of the first plate 123, into a lower end of the second plate 124.

FIG. 19 illustrates a problem when a conventional roller hemming method is applied to a vehicle body, and shows a posture in which the first plate 123 is placed on the hemming die 101, and the erected flange 122 is bent onto the second plate 124 placed on the first plate 123, using a roller 106.

At this time, although the rear wheel arch 121 is pressed down by the clamping arms 104A, 104B, 104C, and 104D, the first plate 123 is a rigid member constituting a vehicle body. Thus, the first plate is hardly bent, and consequently, the gap 125 remains.

If roller hemming is performed until the gap 125 remains, troubles defects of a finished shape, such as wrinkling or ruffling, are caused. Since the gap 125 is not allowable, if a clamping force is increased for the purpose of correcting the gap 125, a pressing flaw will occur in the wheel arch 121, or the wheel arch 121 will deform.

From the above reason, the roller hemming using the conventional hemming die 101 cannot be applied to rigid members, such as a white body.

DISCLOSURE OF THE INVENTION

The object of the invention is to provide a roller hemming technique that is applicable even to rigid members, such as a white body.

According to a first aspect of the invention, there is provided a roller hemming apparatus that brings a second plate into contact with a first plate having an erected flange at an edge thereof, and bends the erected flange by a roller while the first plate is received in a receiving die, thereby winding the edge of the first plate around an edge of the second plate. Here, the receiving die movably includes a clamping mechanism that pinches at least the first plate, and is a portable die that is used in a state where the clamping mechanism grasps the first plate.

In a second aspect of the invention, the clamping mechanism is provided in the receiving die so as to be movable in a direction in which the receiving die is allowed to be separated from the first plate when the roller presses the erected flange.

In a third aspect of the invention, the roller is adapted to move together with an auxiliary roller that specifies a movement locus, and a guide groove that specifies the movement locus of the auxiliary roller is provided in the receiving die.

In a fourth aspect of the invention, the first plate is a rigid member that is obtained by connecting a plurality of panels and is hard to be bent.

In a fifth aspect of the invention, there is provided a roller hemming method of bringing a second plate into contact with a first plate having an erected flange at an edge thereof, and bending the erected flange by a roller while the first plate is received in a receiving die, thereby winding the edge of the first plate around the edge of the second plate. Here, hemming is performed while the first plate is brought into tightly contact with the receiving die at a portion of the roller and the first plate is allowed to be separated from the receiving die at another portion.

In the first aspect of the invention, since the receiving die is a portable die that is used in a state where the clamping mechanism grasps the first plate, the receiving die can be attached to a tip of a robot arm. Also, since the receiving die is movable with respect to the first plate, the receiving die itself is displaced if a large force is applied to the clamping mechanism during roller hemming.

Although there is conventionally provided a configuration in which a workpiece is made to follow a fixed hemming die, the invention is configured such that a receiving die is made to follow the fixed first plate. Therefore, even of the first plate is a constructional member that is hard to be bent, preferable hemming can be performed without wrinkling, ruffling, or deformation.

In the second aspect of the invention, the clamping mechanism is provided in the receiving die so as to be movable in a direction in which the receiving die is allowed to be separated from the first plate when the roller presses the erected flange. If the receiving die is separated from the first plate, the clamping mechanism can be attached to the receiving die by simple combination of a rail and a slider. Thus, the roller hemming apparatus can be simplified, and the cost of the apparatus can be reduced.

In the third aspect of the invention, the roller is guided by providing the guide groove in the receiving die. A robot is taught in advance so as to move along the erected flange extending from the first plate, but deviation occurs inevitably between this teaching and the actual movement locus of a robot arm. In the invention, the roller is guided by the roller guide. Thus, there is no probability that deviation may occur. As a result, hemming professing of the erected flange can be performed correctly.

The fourth aspect of the invention is applied to a rigid member that is obtained by connecting a plurality of panels and is hard to be bent. That is, hemming can be performed on the rigid member, such as a white body, and working cost can be reduced.

In the fifth aspect of the invention, hemming is performed while the first plate is brought into tightly contact with the receiving die at the portion of the roller and the first plate is allowed to be separated from the receiving die at another portion. Although there is conventionally provided a configuration in which a workpiece is made to follow a fixed hemming die, the invention is configured such that the receiving die is made to follow the fixed first plate. Therefore, even of the first plate is a constructional member that is difficult to be bent, preferable hemming can be performed without wrinkling, ruffling, or deformation.

Other aspects and advantages of the invention will be apparent from the following description and the appended claims.

REFERENCE NUMERALS

10: RECEIVING DIE CONSTITUTING HEMMING APPARATUS
12: FIRST GUIDE GROOVE
13: SECOND GUIDE GROOVE
20A to 20C: CLAMPING MECHANISM
21: RAIL
22: SLIDER BLOCK
40: ROLLER MECHANISM CONSTITUTING HEMMING APPARATUS
48: ROLLER
51: AUXILIARY ROLLER
60: WHITE BODY SERVING AS WORKPIECE
63: FIRST PLATE
64: SECOND PLATE
65: ERECTED FLANGE

BEST MODE FOR CARRYING OUT THE INVENTION

Figure 1:
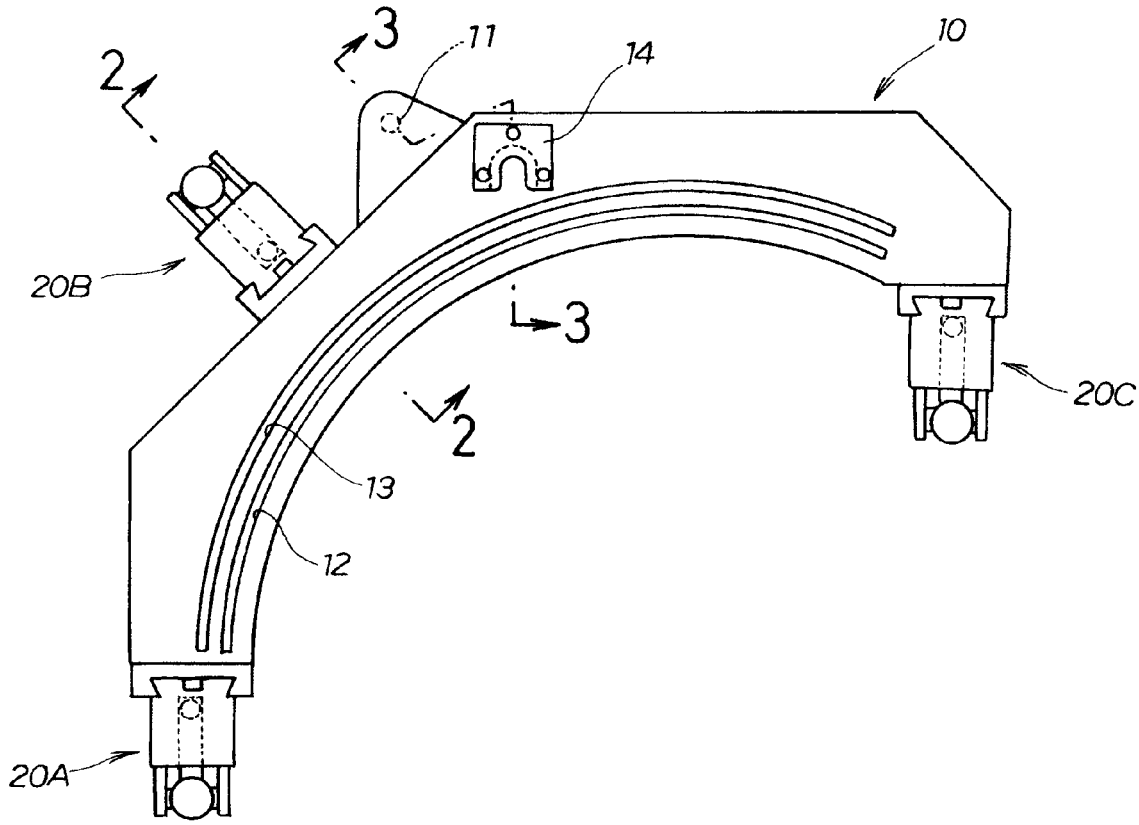
FIG. 1 is a front view of a receiving die of a roller hemming apparatus according to an exemplary embodiment of the invention.

Exemplary embodiments of the invention will be described below with reference to the accompanying drawings. Further, the drawings should be seen in directions of reference numerals. FIG. 1 is a front view of a receiving die of a roller hemming apparatus according to an exemplary embodiment of the invention. This roller hemming apparatus includes a roller mechanism (reference numeral 40 in FIGS. 4 and 5) attached to a robot arm, and a receiving die 10 detachably attached to an attachment.

The receiving die 10 includes a receiving face (will be described in FIG. 2) and a locating pin 11 on a reverse side of the drawing. The receiving die 10 includes a first guide groove 12, a second guide groove 13, and a chuck part 14 that can perform chucking from an outside, on an obverse side of the drawing. The receiving die 10 includes clamping mechanisms 20A, 20B, and 20C, at a lower left end, an upper line, and a right end, respectively.

Figure 2:
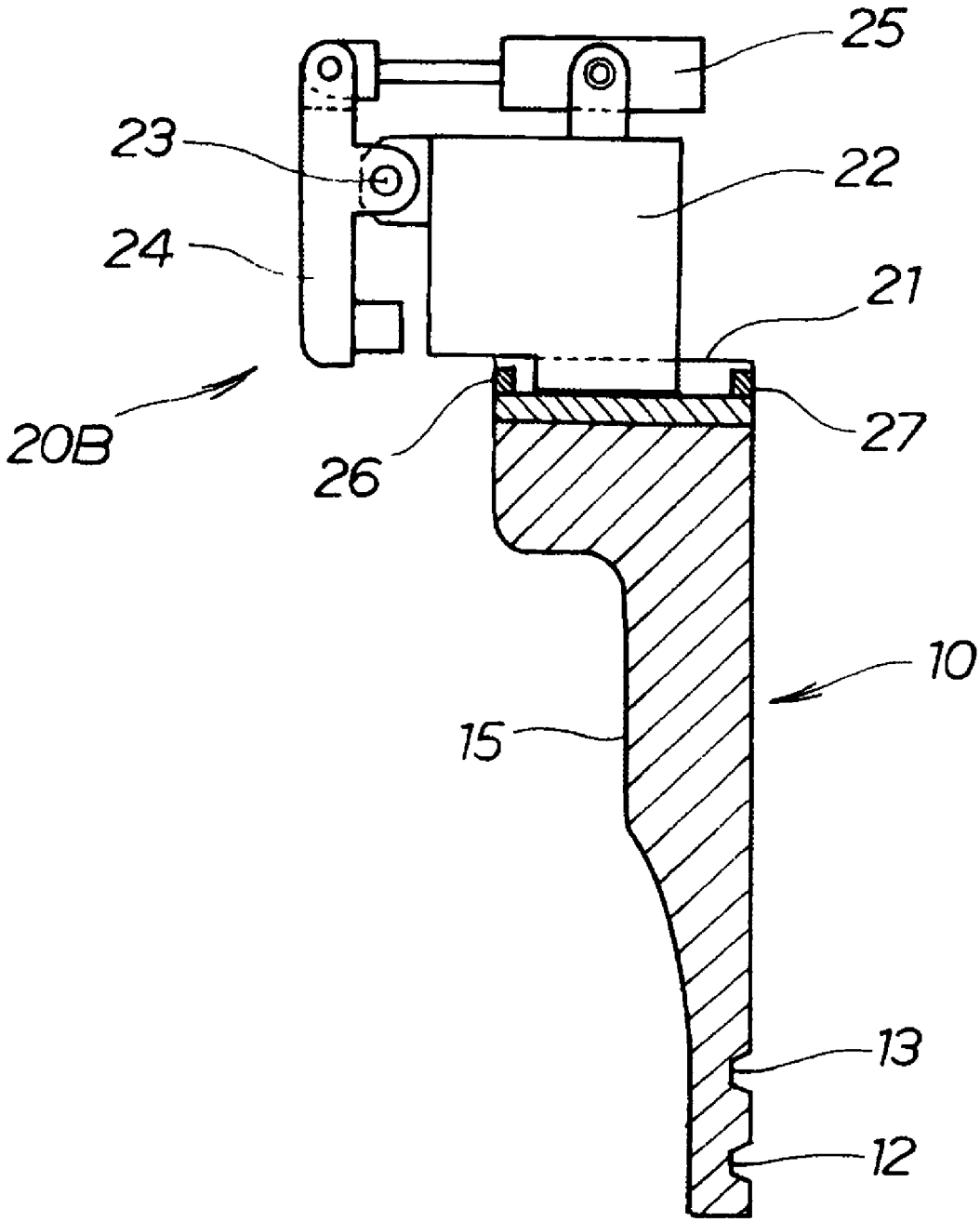
FIG. 2 is a sectional view taken along the line 2-2 of FIG. 1.

FIG. 2 is a sectional view taken along the line 2-2 of FIG. 1. Referring to FIG. 2, an outer face (right face in the drawing) of the receiving die 10 is provided with the first guide groove 12 and the second guide groove 13, and an inner face (left face in the drawing) of the receiving die 10 is provided with the receiving face 15. The clamping mechanism 20B includes a rail 21 provided at the receiving die 10, a slider block 22 movably attached to the rail 21, a clamping arm 24 swingably fixed to the slider block 22 by the pin 23, and a cylinder unit 25 attached to the slider block 22 in order to swing the clamping arm 24.

Since the slider block 22 moves along the rail 21 freely, a pair of stoppers 26 and 27 is provided to prevent the slider block 22 from coming off from the rail 21. Accordingly, the slider block 22 can move freely by a fixed distance.

Since the clamping mechanisms 20A and 20C shown in FIG. 1 are also the same structure, reference numerals are commonly used and the description thereof is omitted.

Figure 3:
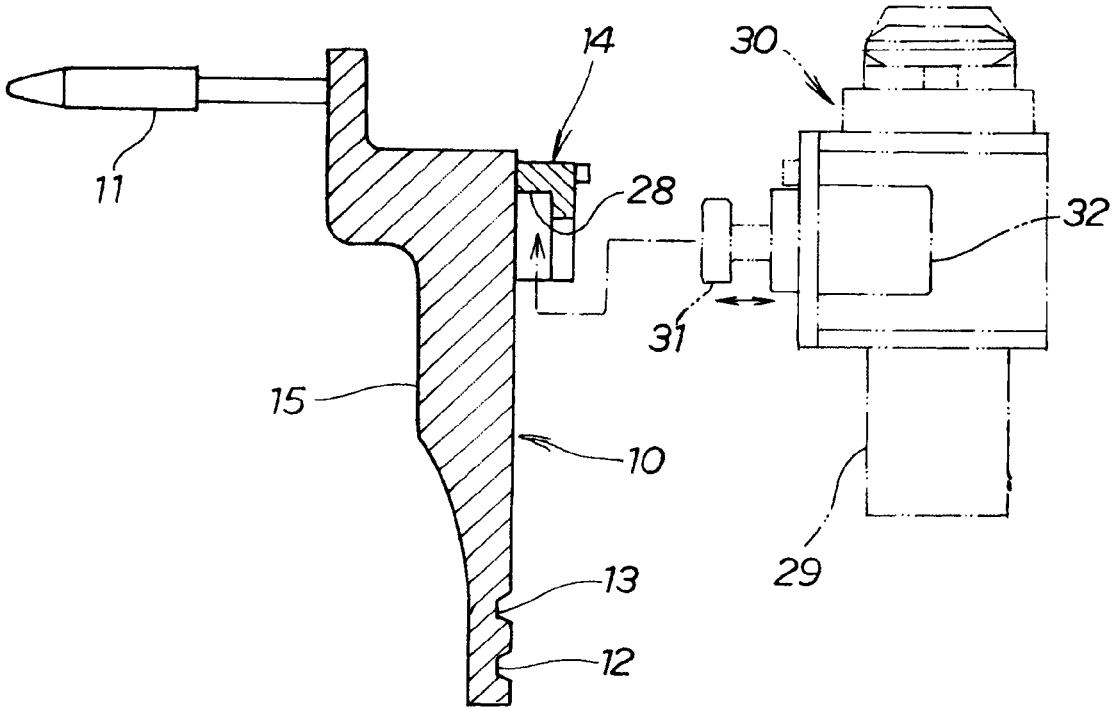
FIG. 3 is a sectional view taken along the line 3-3 of FIG. 1.

FIG. 3 is a sectional view taken along the line 3-3 of FIG. 1. Referring to FIG. 3, the locating pin 11 made to project from the receiving die 10 is sufficiently long, and the chuck part 14 has a pocket portion 28. A member indicated by an imaginary line is an attachment 30 attached to the tip of a robot arm 29.

A chuck disk 31 provided at the attachment 30 can be inserted into the pocket portion 28 like an arrow. By moving the chuck disk 31 by means of an actuator 32, coupling can be completed.

Figure 4:
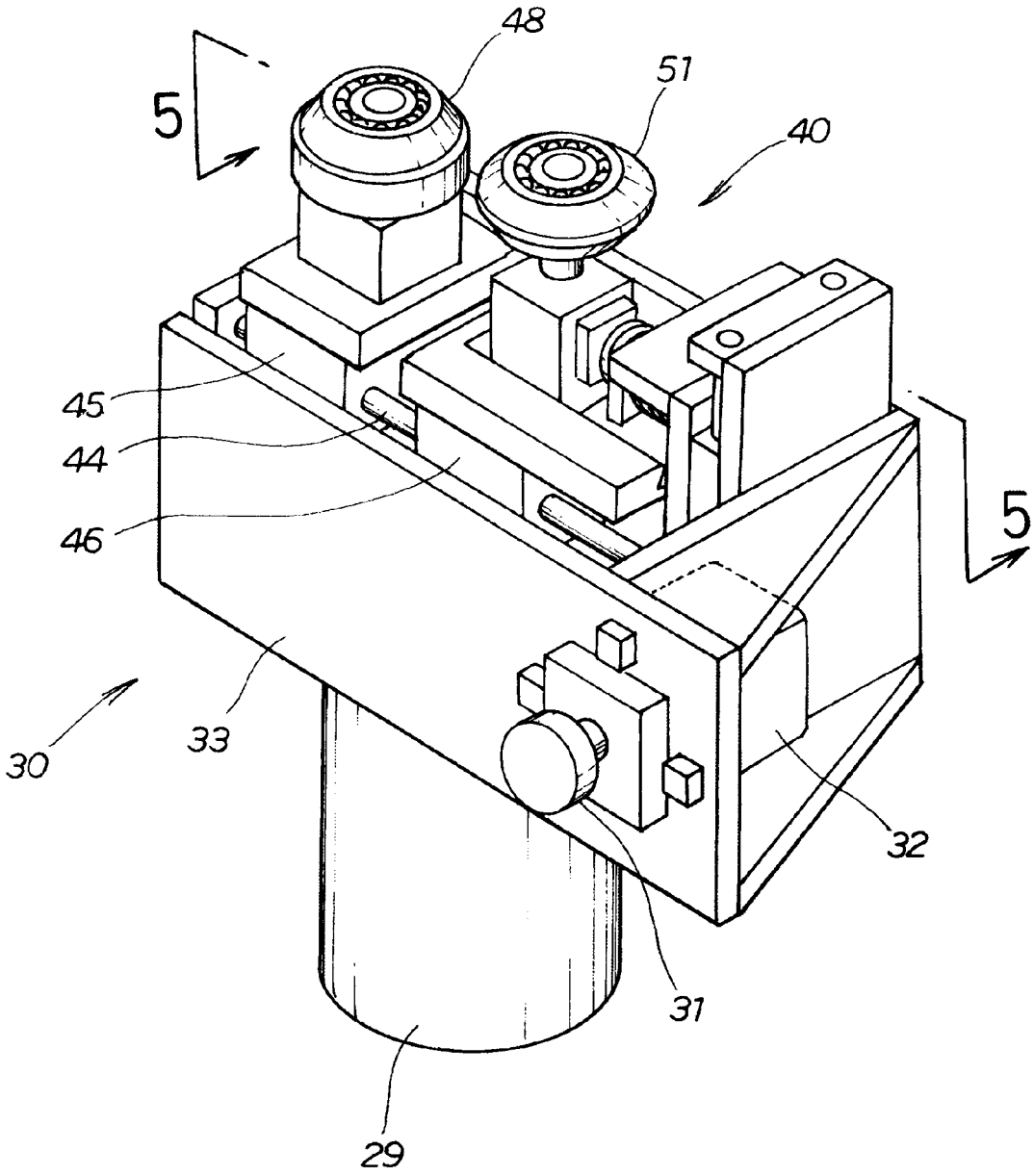
FIG. 4 is a perspective view of an attachment according to the exemplary embodiment of the invention.

FIG. 4 is a perspective view of an attachment according to the exemplary embodiment of the invention. Referring to FIG. 4, the attachment 30 includes a frame 33 attached to the robot arm 29, the actuator 32 attached to the frame 33, the chuck disk 31 attached to the actuator 32, and a roller mechanism 40 (the details thereof will be described referring to the following drawings) that receives chief parts in the frame 33.

Figure 5:
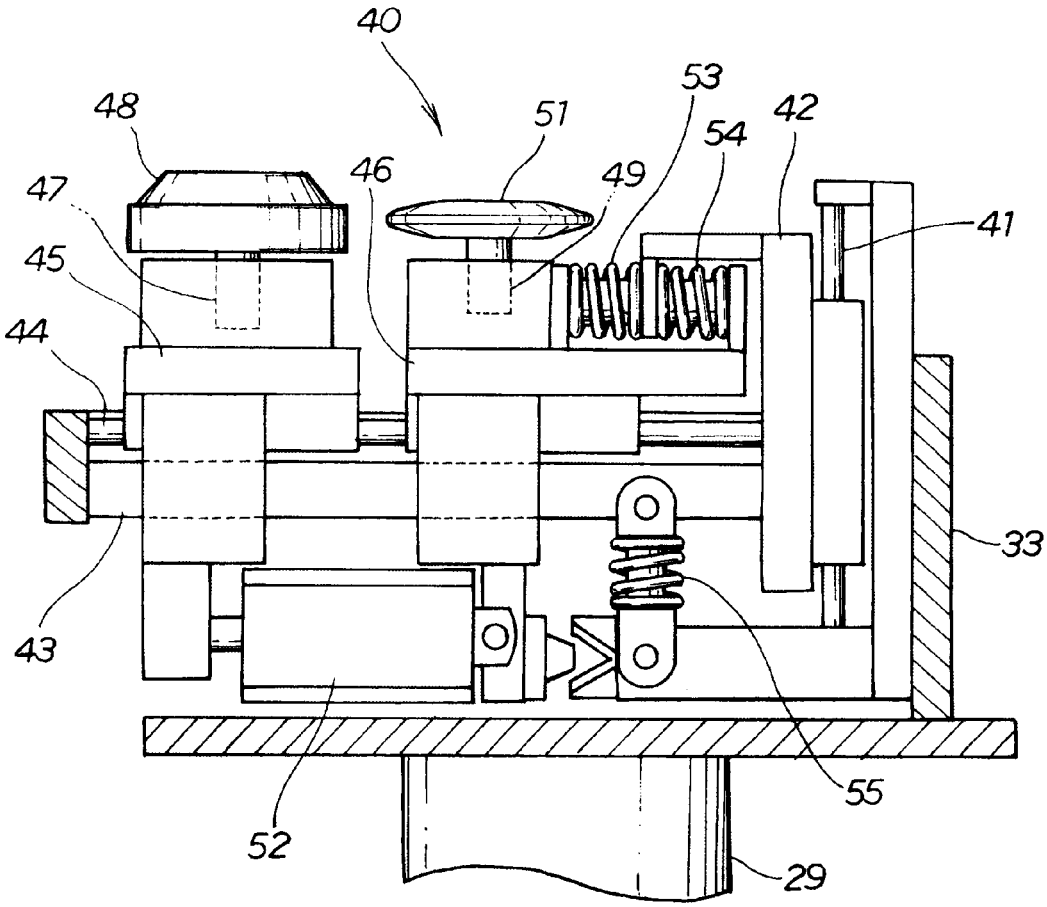
FIG. 5 is a sectional view taken along the line 5-5 of FIG. 4.

FIG. 5 is a sectional view taken along the line 5-5 of FIG. 4. Referring to FIG. 5, the roller mechanism 40 includes a first rail 41 provided in the frame 33, a first slider 42 movably attached to the first rail 41, a sub frame 43 and a second rail 44 that extends in a direction orthogonal to the first rail 41 from the first slider 42, a second slider 45 and a third slider 46 movably attached to the second rail 44, a roller 48 rotatably attached to the second slider 45 via a spindle 47, an auxiliary roller 51 rotatably attached to the third slider 46 via a spindle 49, an hydraulic cylinder 52 that connects the third slider 46 to the second slider 45, and adjusts the spacing between sliders, and the thrust of a roller 48, elastic bodies 53 and 54 that elastically support the third slider 46 on the first slider 42, and an elastic body 55 that elastically supports the first slider 42 on the frame 33. The elastic bodies 53, 54, and 55 may be any one of a spring and a cushion rubber.

The frame 33 is positioned by the robot arm 29. The roller 48 is movable up and down in the drawing with respect to such a frame 33 by elastic supporting operation of the elastic body 55, and is movable to the right and left in the drawing by elastic supporting operation of the elastic bodies 53 and 54.

Figure 6:
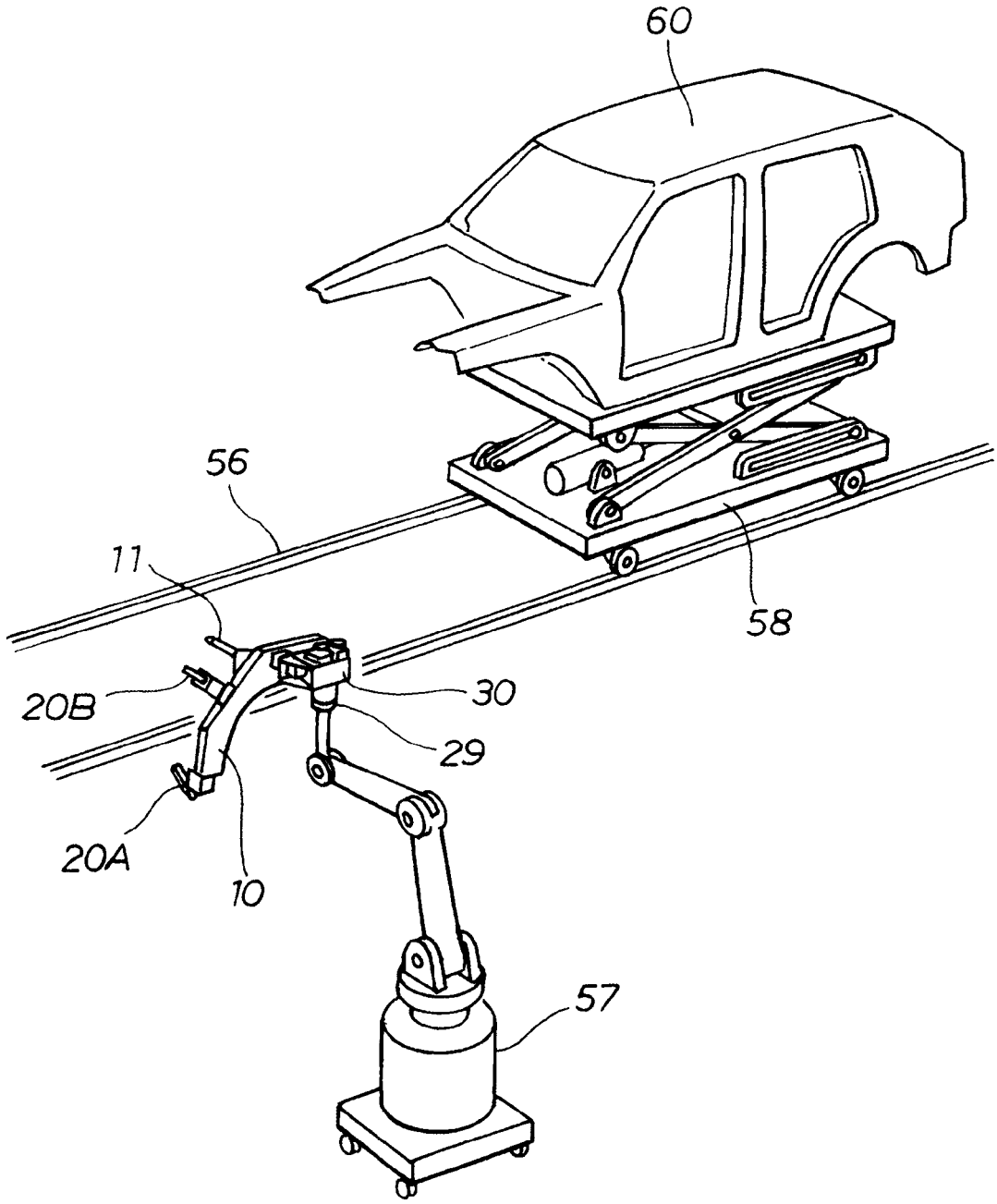
FIG. 6 is an explanatory view during receiving die standby according to the exemplary embodiment of the invention.

The operation of a roller hemming apparatus including the receiving die and roller mechanism as described above will be described below. FIG. 6 is an explanatory view during standby of the receiving die according to the invention. Referring to FIG. 6, a robot 57 is arranged in a production line 56, and the robot arm 29 of the robot 57 grasps the receiving die 10, and is made to be on standby in this state. Then, a white body 60 placed on a movable carriage 58 is conveyed to near the robot 57.

Figure 7A:
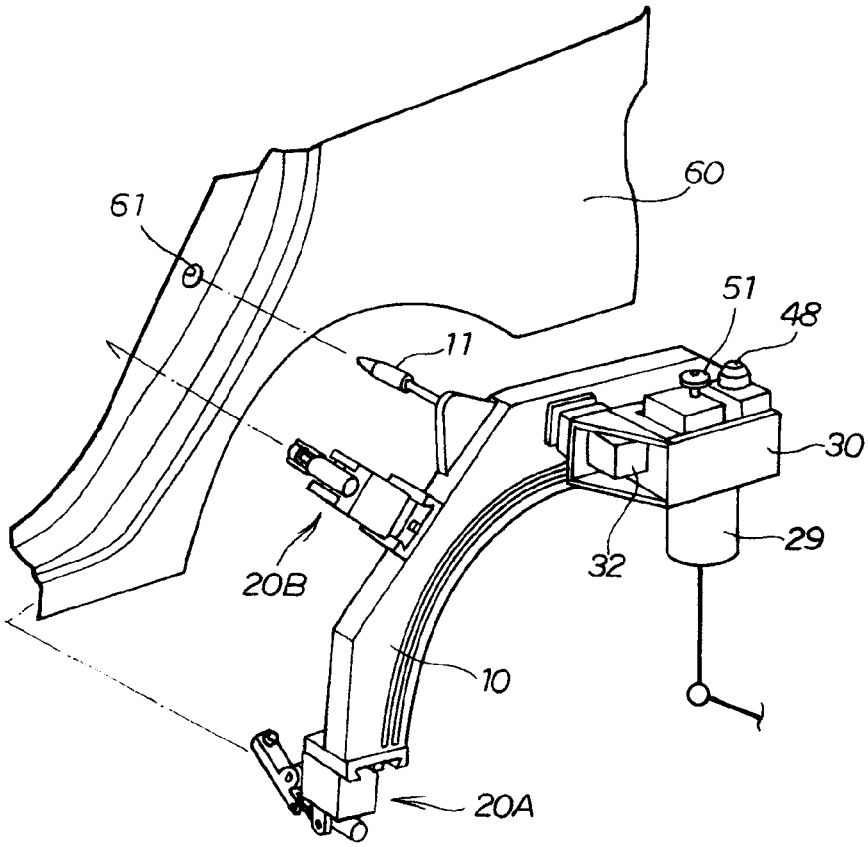
FIGS. 7(*a*) and 7(*b*) are explanatory views at the time of starting of setting the receiving die according to the exemplary embodiment of the invention.
Figure 7B:
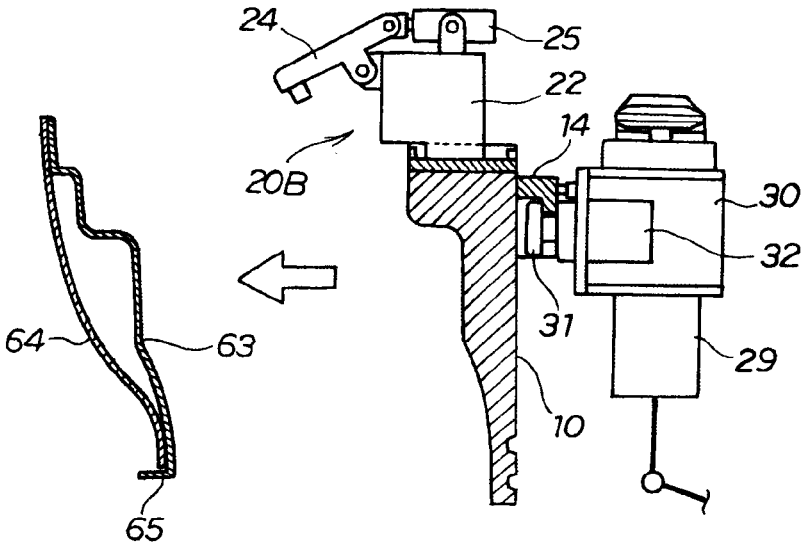

FIGS. 7(*a*) and 7(*b*) are explanatory views at the time of starting of setting of the receiving die according to the exemplary embodiment of the invention. Referring to FIG. 7(*a*), the receiving die 10 is advanced by the robot arm 29 in such a way that the locating pin 11 on the side of the receiving die 10 is inserted into the hole 61 on the side of the white body 60. FIG. 7(*b*) is a supplementary view of FIG. 7(*a*). Referring to FIG. 7(*b*), the clamping arm 24 of the clamping mechanism 20B provided in the receiving die 10 is maintained in an unclamping position, and the receiving die 10 is advanced as indicated by an open arrow.

Figure 8A:
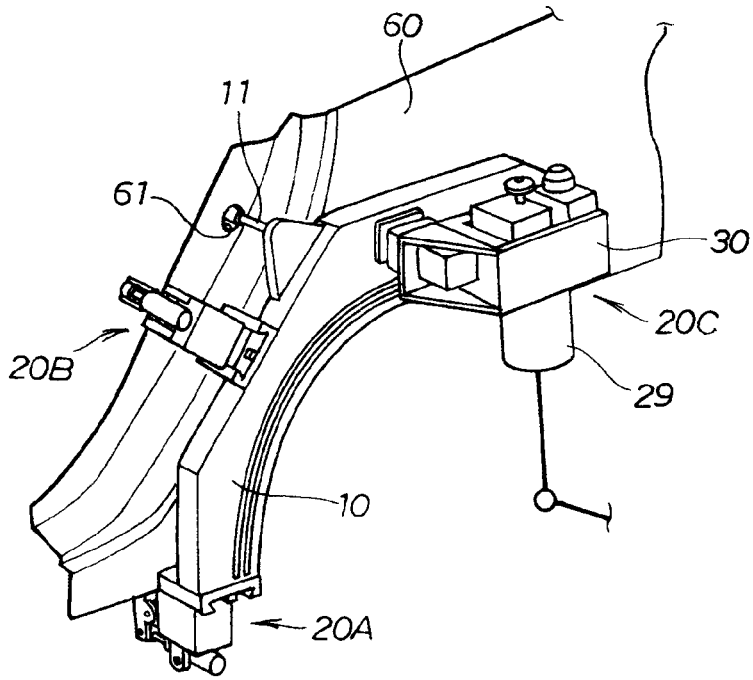
FIGS. 8(*a*) and 8(*b*) are explanatory views at the time of completion of setting the receiving die according to the exemplary embodiment of the invention.
Figure 8B:
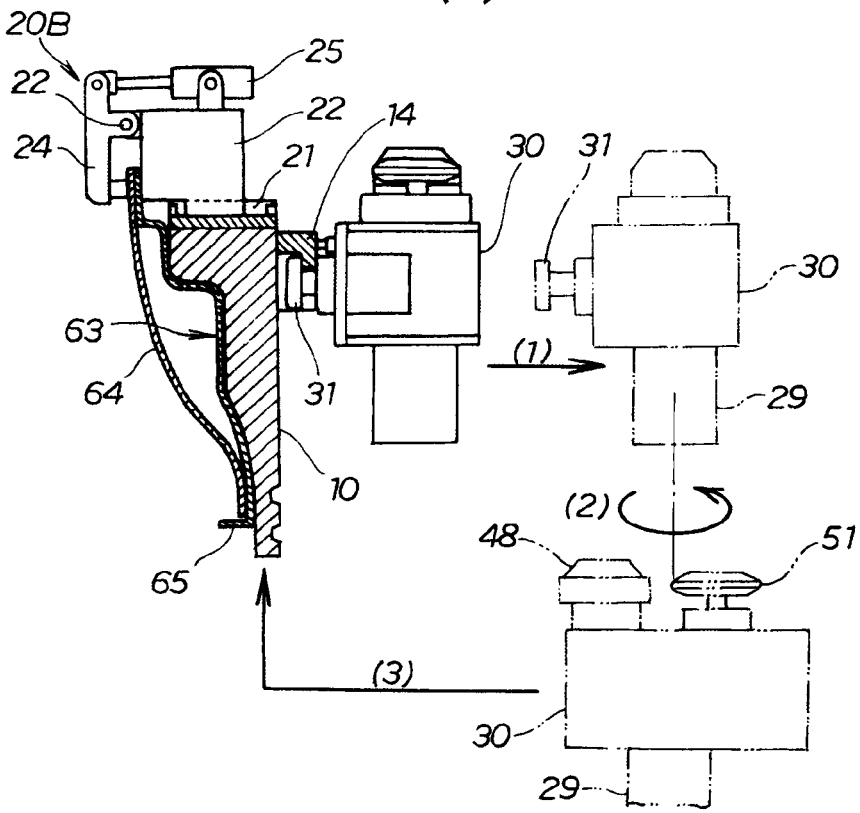

FIGS. 8(*a*) and 8(*b*) are explanatory views at the time of completion of setting of the receiving die according to the exemplary embodiment of the invention. In FIG. 8(*b*), the clamping arm 24 is swung towards the clamp by the cylinder unit 25, and a first plate 63 and a second plate 64 are pinched by the slider block 22 and the clamping arm 24. The receiving die 10 will be supported at least on the first plate 63 via the clamping mechanism 20B.

Thereafter, the attachment 30 is removed from the receiving die 10 as indicated by an arrow (1). Then, the attachment 30 is turned as indicated by an arrow (2) so that the roller 48 directs in the front direction and moves downward, and the roller 48 moves below the receiving die 10 as indicated by an arrow (3).

FIG. 8(*a*) shows the receiving die 10 that is set in the rear wheel arch of the white body 60 by the clamping mechanisms 20A, 20B, and 20C (20C exists in the shade of the attachment 30). That is, the receiving die 10 will be supported by the white body 60 by the clamping operation of the clamping mechanisms 20A, 20B, and 20C. As a result, the attachment 30 can be removed.

Figure 9:
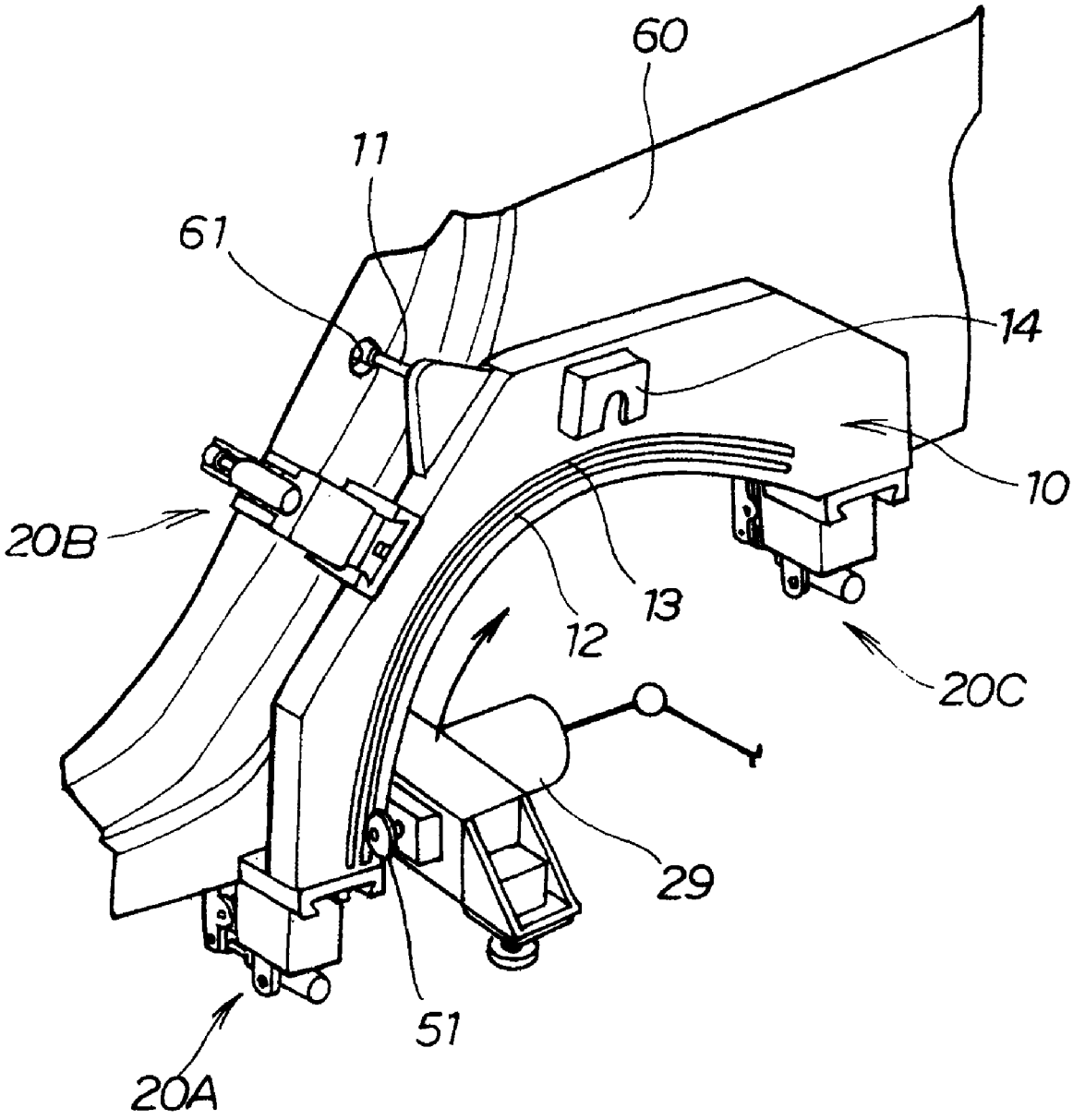
FIG. 9 is an explanatory view of a hemming process according to the exemplary embodiment of the invention.

FIG. 9 is an explanatory view of a hemming process according to the exemplary embodiment of the invention. Referring to FIG. 9, the robot arm 29 is moved as indicated by an arrow. Then, the auxiliary roller 51 can move along the first guide groove 12 or the second guide groove 13, and can perform predetermined hemming processing. The details of this hemming processing will be described below.

Figure 10A:
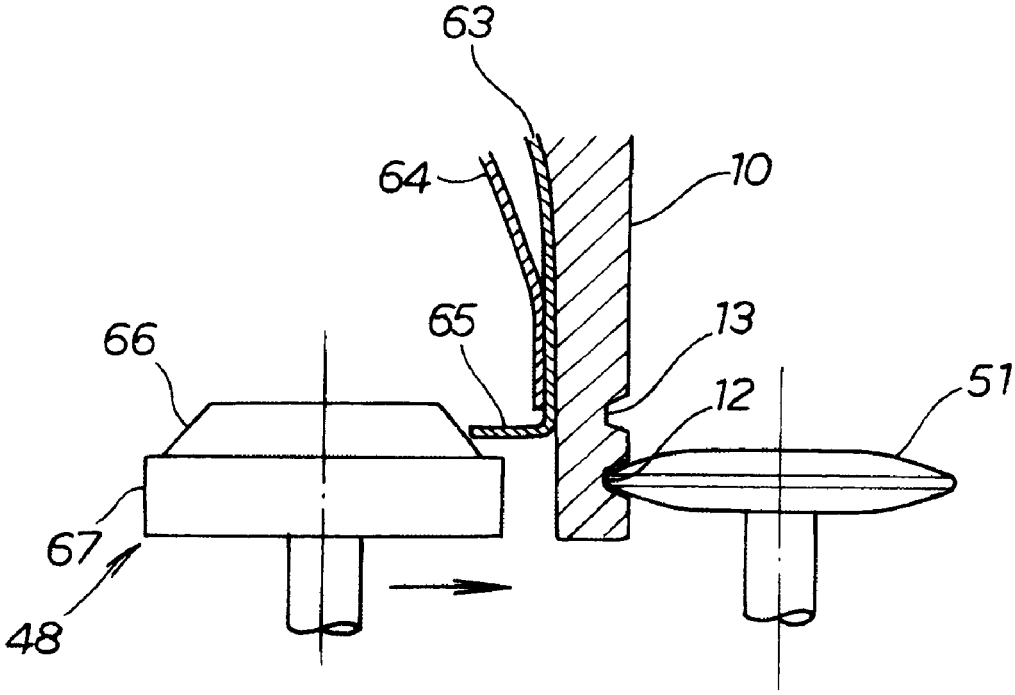
FIGS. 10(*a*) and 10(*b*) are explanatory views of preliminary hemming processing according to the exemplary embodiment of the invention.
Figure 10B:
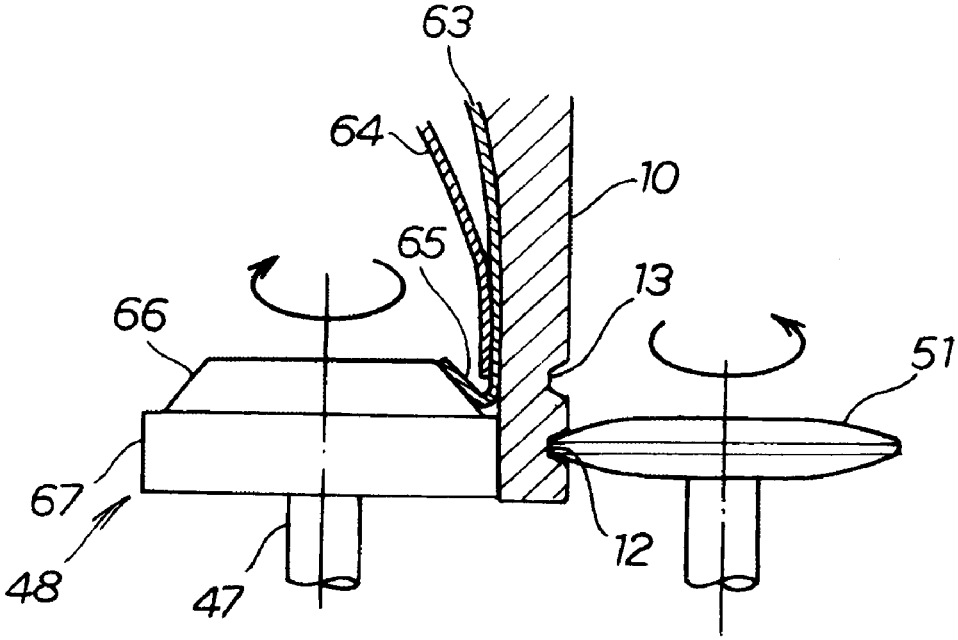

FIGS. 10(*a*) and 10(*b*) are explanatory views of preliminary hemming processing according to the exemplary embodiment of the invention. As a premise of processing, the second plate 64 overlaps the first plate 63 that has an erected flange 65 at a lower end thereof, and the receiving die 10 touches the first plate 63. Referring to FIG. 10(*a*), subsequent to the arrow (3) of FIG. 8(*b*), the auxiliary roller 51 is fitted into the first guide groove 12, and the auxiliary roller 51 is brought close to the roller 48. This operation is implemented by the hydraulic cylinder 52 of FIG. 5.

Referring to FIG. 10(*b*), the roller 48 and the auxiliary roller 51 are moved in obverse and reverse directions of the drawing. The erected flange 65 can be bent at about 45° by an inclined face 66 provided in the roller 48. This bending processing of about 45° is called preliminary hemming processing. If the preliminary hemming processing is completed, the roller 48 is separated from the auxiliary roller 51, and the roller 48 and the auxiliary roller 51 are moved by a fixed distance.

Figure 11A:
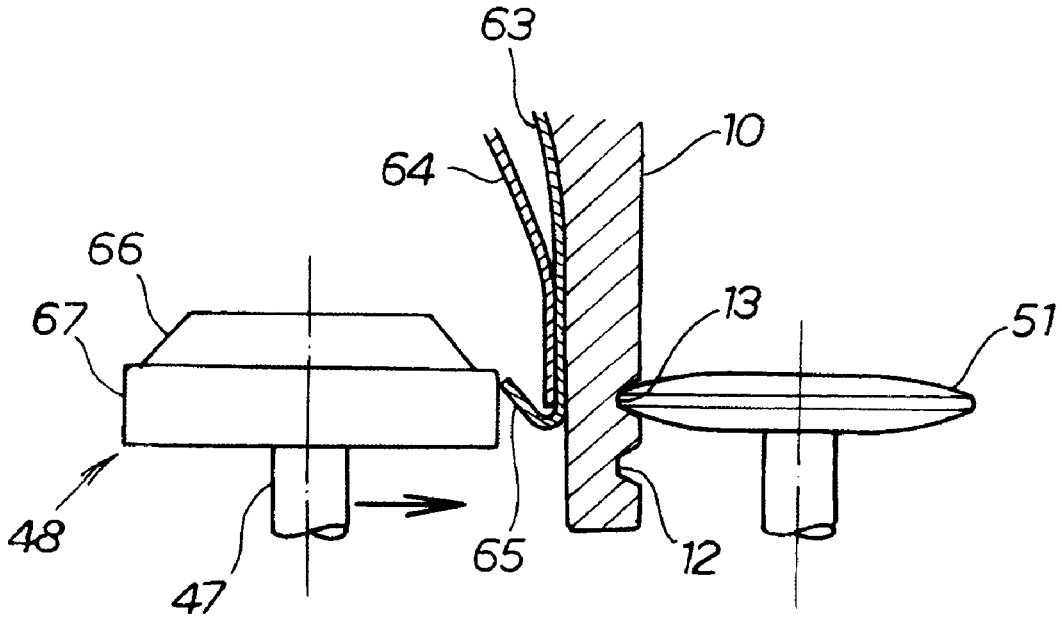
FIGS. 11(*a*) and 11(*b*) are explanatory views of main hemming processing according to the exemplary embodiment of the invention.
Figure 11B:
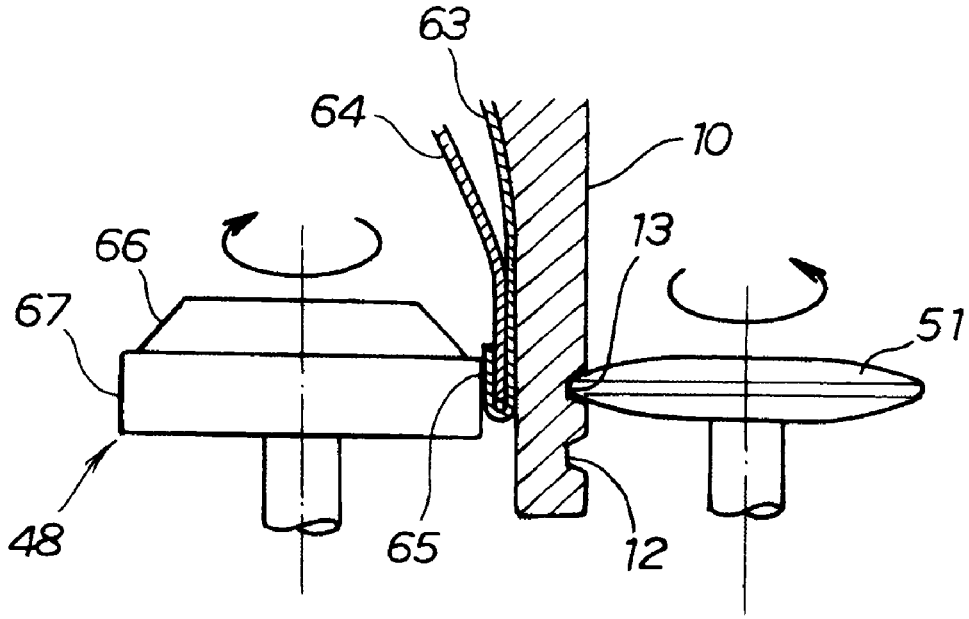

FIGS. 11(*a*) and 11(*b*) are explanatory views of main hemming processing according to the exemplary embodiment of the invention. Referring to FIG. 11(*a*), the auxiliary roller 51 is fitted into the second guide groove 13, and the auxiliary roller 51 is brought close to the roller 48. At this time, not the inclined face 66 but the roller face 67 parallel to the spindle 47 faces the erected flange 65.

Referring to FIG. 11(*b*), the roller 48 and the auxiliary roller 51 are moved in obverse and reverse directions of the drawing. The erected flange 65 can be completely bent by the roller face 67 provided in the roller 48. This bending processing is called main hemming processing. If the main hemming processing is completed, it is desirable that the roller 48 is separated from the auxiliary roller 51.

Figure 12A:
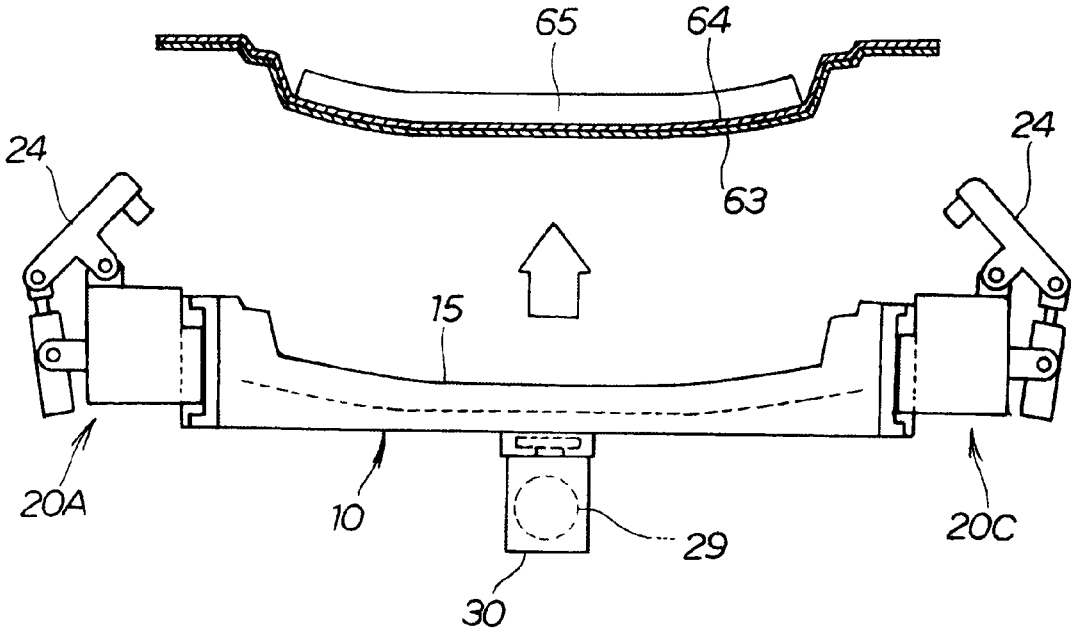
FIGS. 12(*a*) and 12(*b*) are plan views illustrating the operation during the receiving die setting according to the exemplary embodiment of the invention.
Figure 12B:
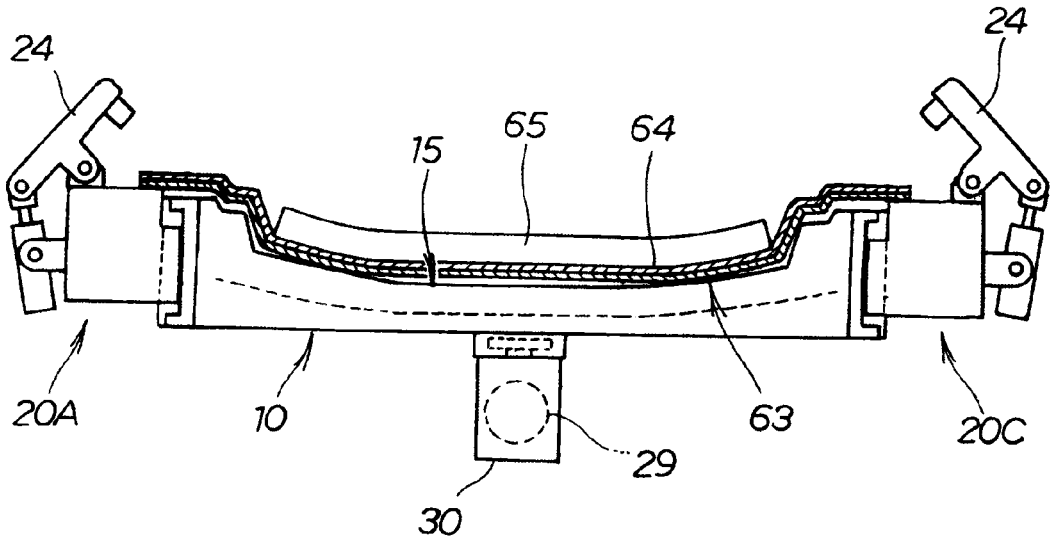

The roller hemming processing described above will be described again referring to a plan view. FIGS. 12(*a*) and 12(*b*) are plan views illustrating the operation during setting of the receiving die according to the exemplary embodiment of the invention. Referring to FIG. 12(*a*), a workpiece is formed by overlapping the first plate 63 with the second plate 64. The erected flange 65 erected from the first plate 63 is shown in FIG. 12(*a*). Then, the receiving die 10 is brought close to the first plate 63 by the robot arm 29. In addition, the clamping arms 24 and 24 of the clamping mechanisms 20A and 20C provided in the receiving die 10 are unclamped. Then, the receiving face 15 is applied to the first plate 63 by moving the receiving die 10 as indicated by the open arrow by means of the robot arm 29. FIG. 12(*b*) shows a state where the receiving die 10 has abutted on the first plate 63.

Figure 13A:
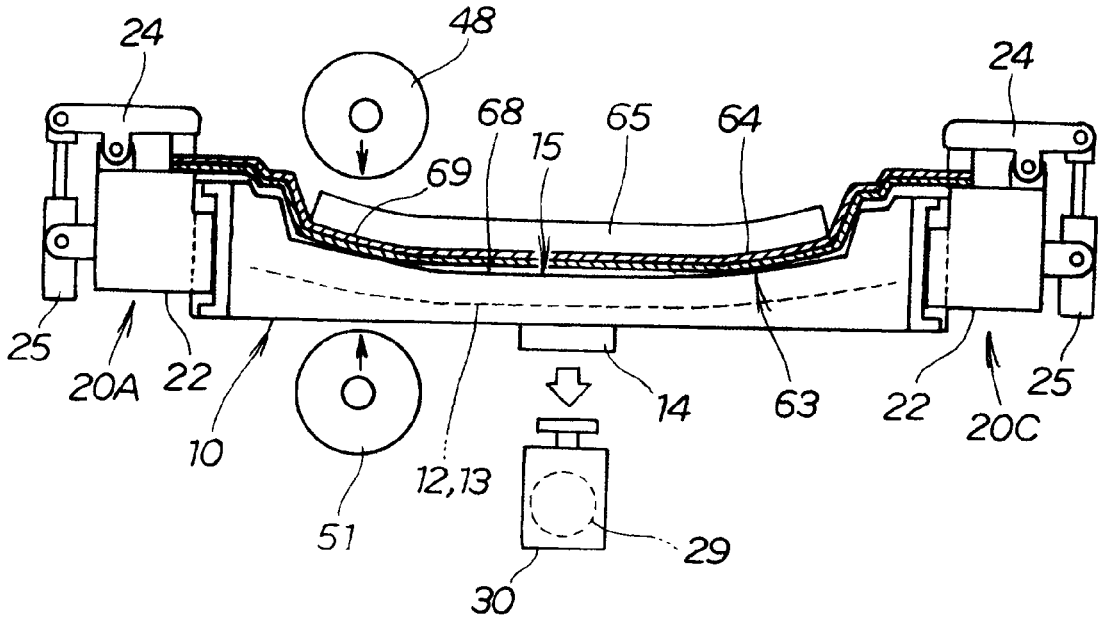
FIGS. 13(*a*) and 13(*b*) are plan views illustrating the operation at the initial stage of roller hemming processing according to the exemplary embodiment of the invention.
Figure 13B:
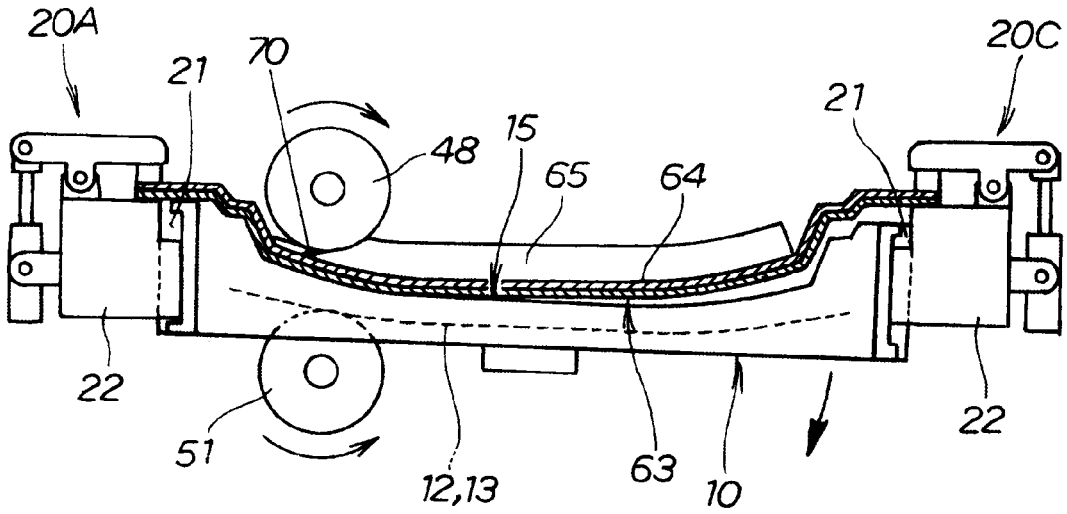

FIGS. 13(*a*) and 13(*b*) are plan views illustrating the operation at the initial stage of the roller hemming processing according to the exemplary embodiment of the invention. Referring to FIG. 13(*a*), the clamping arms 24 and 24 are rotated towards the clamp by cylinder units 25 and 25. As a result, the first plate 63 and the second plate 64 can be pinched by the slider block 22 and the clamping arm 24. Next, the attachment 30 is separated from the receiving die 10. Then, the receiving die 10 will be supported by the first plate 63 and the second plate 64 via the clamping mechanisms 20A and 20C.

Meanwhile, although it is ideal that the shape of the first plate 63 and the shape of the receiving face 15 are the same, the first plate 63 receives the influence of just previous processing, such as press working, welding bonding, etc., and thus a variation occurs in shape. Therefore, an inevitable gap 68 exists between the first plate 63 and the receiving face 15. Next, the auxiliary roller 51 is brought close to the guide groove 12 or 13, and the roller 48 is brought close to a starting point 69 of the erected flange 65.

FIG. 13(*b*) shows the initial state of the roller hemming processing. Referring to FIG. 13(*b*), the erected flange 65 begins to be bent by the roller 48. At this time, the first plate 63 and the receiving face 15 are brought into tightly contact with each other at the contact point 70 between the roller 48 and the erected flange 65 by strong pinching of the roller 48 and the auxiliary roller 51. On the other hand, in portions other than the contact point 70, the receiving face 15 tends to be separated from the first plate 63 by reaction. Since the slider blocks 22 and 22 are movable along the rails 21 and 21 on the side of the receiving die 10, the receiving die 10 rotates clockwise in the drawing about the contact point 70. That is, the receiving die 10 is moved as indicated by an arrow with respect to the clamping mechanism 20C on the right of the drawing.

On the contrary, it can be said that the tight contact in the contact point 70 is guaranteed as the receiving die 10 rotates about the contact point 70. As a result, the hemming processing with a good shape can be achieved without wrinkling, ruffling, or deformation.

Figure 14A:
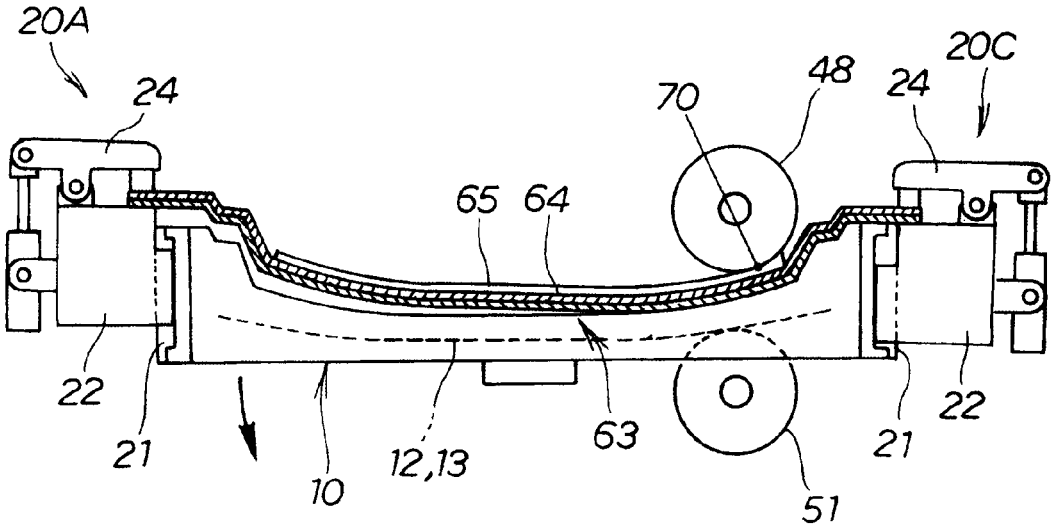
FIGS. 14(*a*) and 14(*b*) are plan views illustrating the operation at the last stage of the roller hemming processing according to the exemplary embodiment of the invention.
Figure 14B:
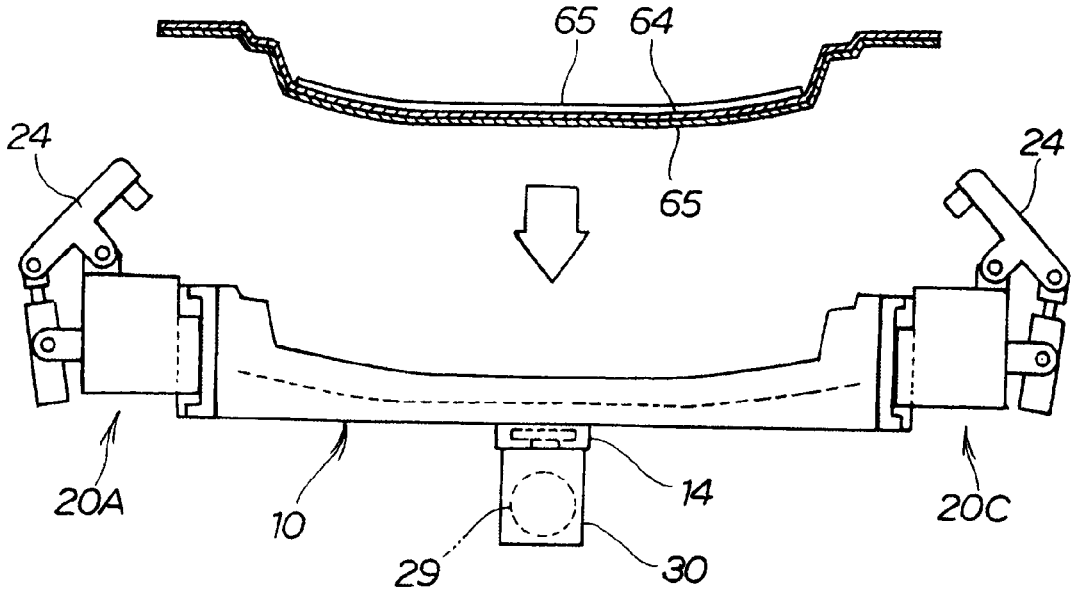

FIGS. 14(*a*) and 14(*b*) are plan views illustrating the operation at the last stage of the roller hemming processing according to the exemplary embodiment of the invention. Referring to FIG. 14(*a*), since the slider blocks 22 and 22 are movable along the rails 21 and 21, the receiving die 10 rotate counterclockwise in the drawing about the contact point 70. That is, the receiving die 10 is moved as indicated by an arrow with respect to the clamping mechanism 20A on the left of the drawing. As a result, the tight contact in the contact point 70 can be maintained. Referring to FIG. 14(*b*), the hemming processing is completed by detaching the receiving die 10 from the first plate 63.

The roller hemming processing of the invention can be arranged as follows from the above description. The invention provides a roller hemming method of bringing a second plate into contact with a first plate having an erected flange at the edge thereof, and bending the erected flange by a roller while the first plate is received in a receiving die, thereby winding the edge of the first plate around the edge of the second plate. In this method, the first plate is brought into tightly contact with the receiving die at the portion of the roller, but hemming is performed allowing the first plate to be separated from the receiving die at the other portions.

Although there is conventionally provided a configuration in which a workpiece is made to follow a fixed hemming die, the invention is configured such that a receiving die is made to follow a fixed first plate. Therefore, even of the first plate is a constructional member that is hard to be bent, preferable hemming can be performed without wrinkling, ruffling, or deformation.

Figure 15A:
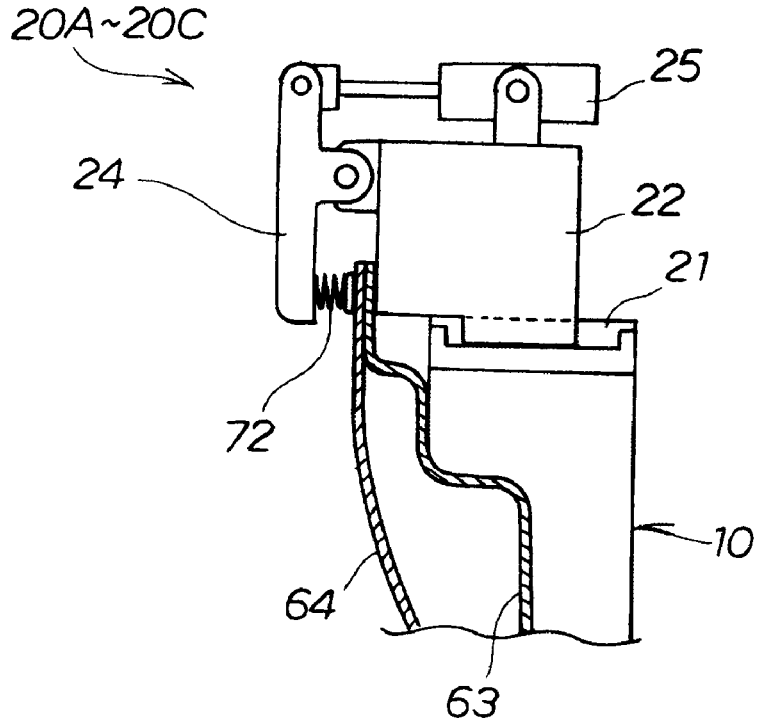
FIGS. 15(*a*) and 15(*b*) show a clamping mechanism printing according to another exemplary embodiment of the invention.
Figure 15B:
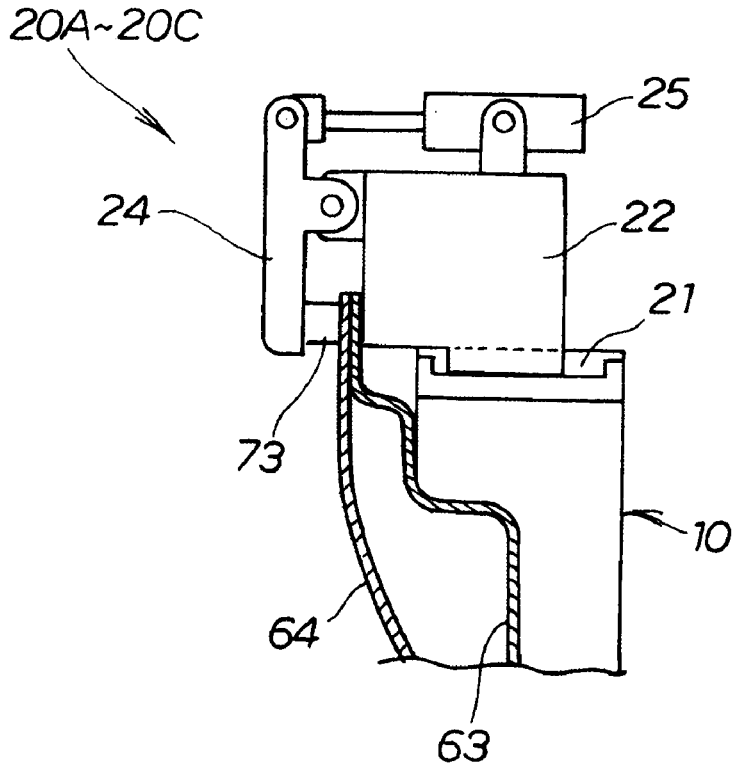
Figure 16A:
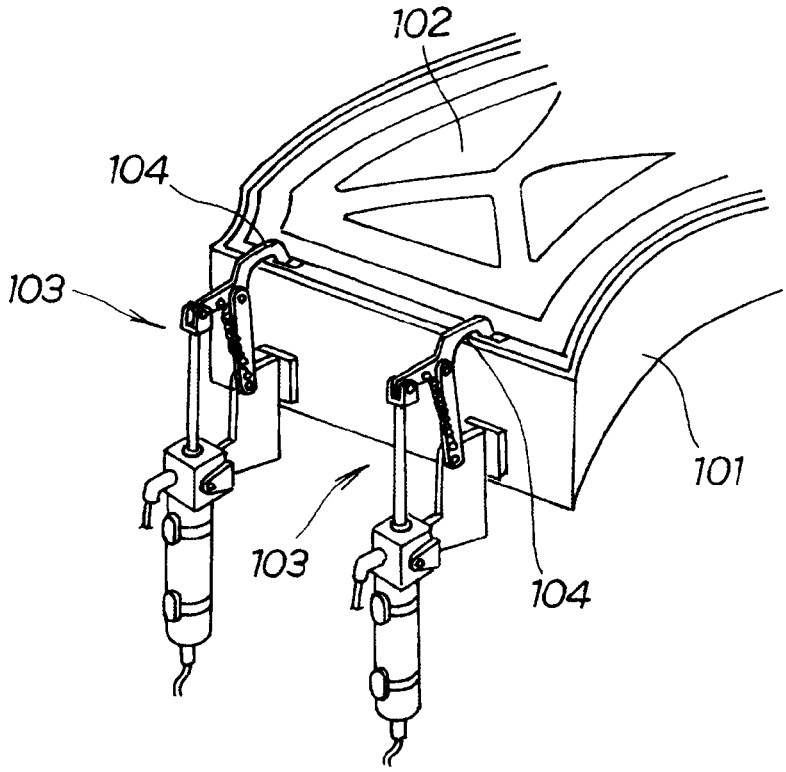
FIGS. 16(*a*) and 16(*b*) illustrate the basic principle of a conventional technique.
Figure 16B:
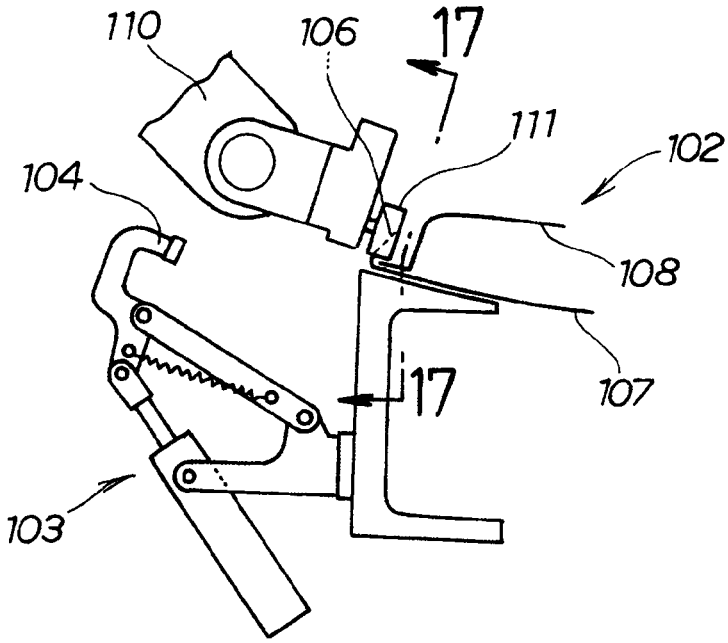
Figure 17:
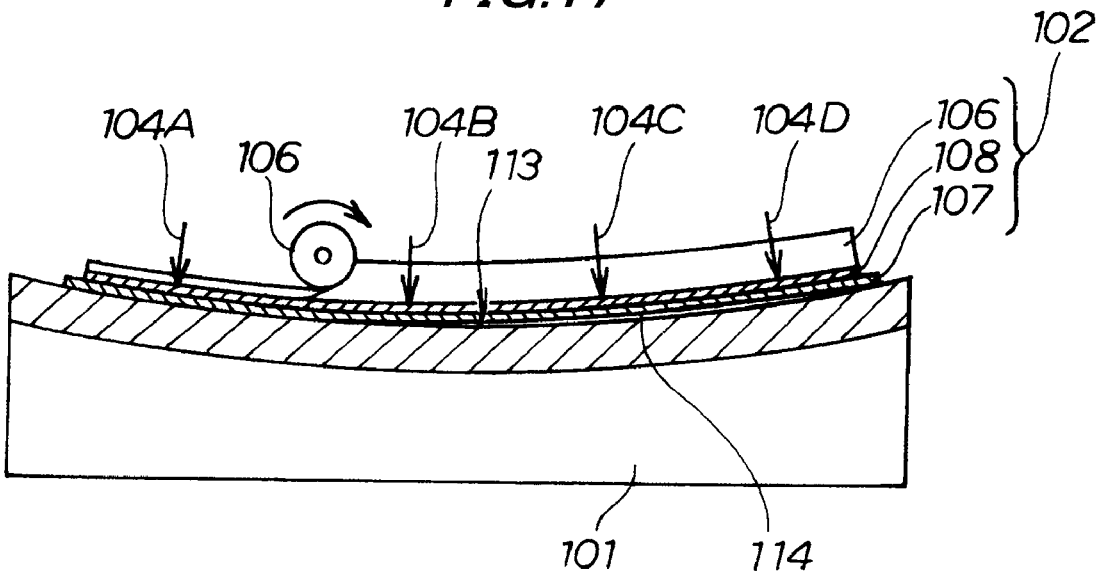
FIG. 17 is a sectional view taken along the line 17-17 of FIG. 16(*b*).
Figure 18A:
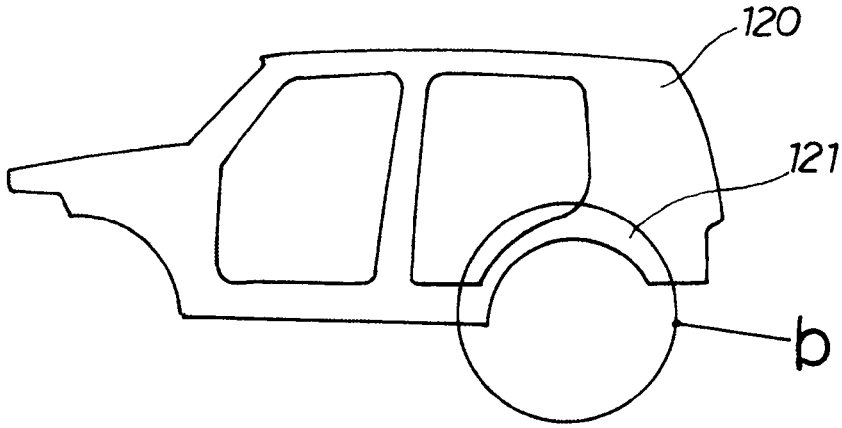
FIGS. 18(*a*) to 18(*d*) are explanatory views when a conventional roller hemming method is applied to a vehicle body.
Figure 18B:
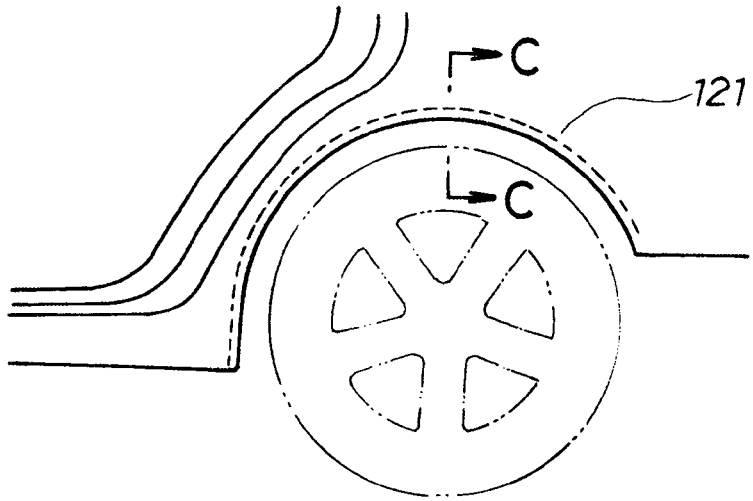
Figure 18C:
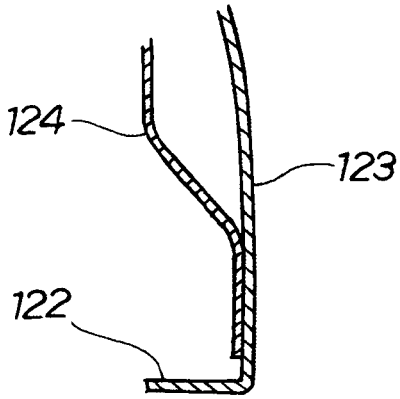
Figure 18D:
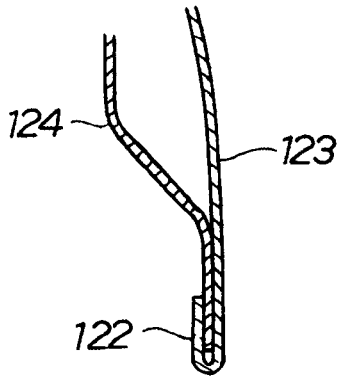
Figure 19:
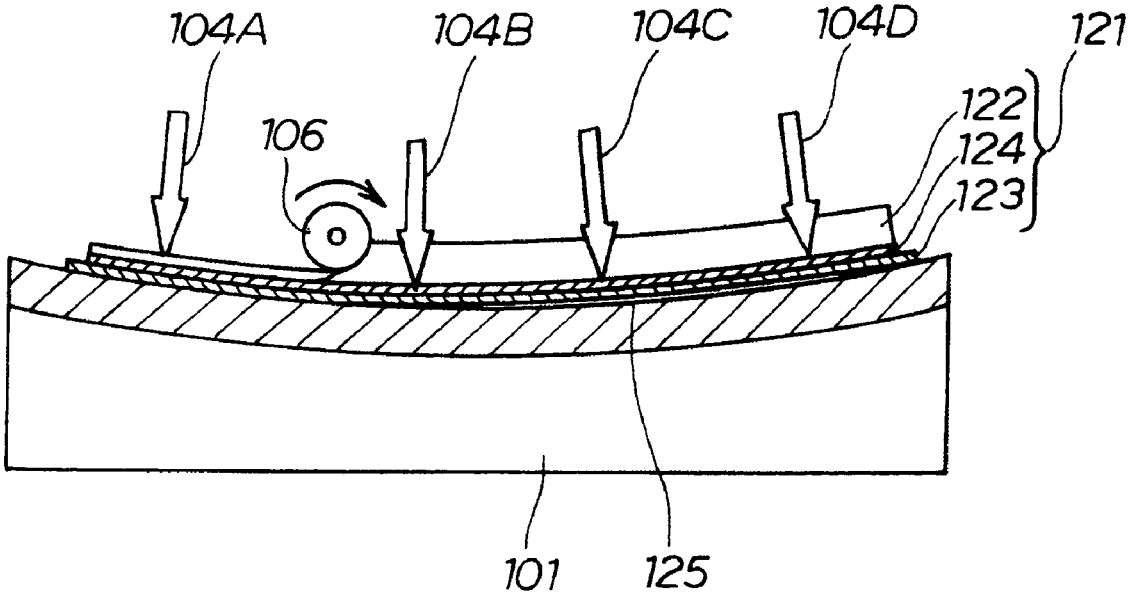
FIG. 19 is an explanatory view illustrating problems when a conventional roller hemming method is applied to a vehicle body.

FIGS. 15(*a*) and 15(*b*) show a clamping mechanism printing according to another exemplary embodiment of the invention. As shown in FIG. 15(*a*), a spring 72 may be attached to the tip of the clamping arm 24 of each of the clamping mechanisms 20A to 20C such that the first plate 63 and the second plate 64 are pressed against the slider block 22 by the elastic action of the spring 72. Further, as shown in FIG. 15(*b*), a rubber piece 73 may be attached to the tip of the clamping arm 24 of each of the clamping mechanisms 20A to 20C such that the first plate 63 and the second plate 64 are pressed against the slider block 22 by the elastic action of the rubber piece 73.

In addition, although the invention has been applied to the rear wheel arch of the white body, the invention can be applied arbitrarily. In short, the invention may be applied to any portions so long as the portions are such that the second plate is overlapped on the first plate, and the erected flange is bent, thereby performing hemming. Further, the workpiece may be general liquid structures other than the white body, and the type of the workpiece is not limited.

Although the invention has been described in detail with reference to the specific embodiments, it is apparent to those skilled in the art that various modifications and variations can be made without departing from the spirit and scope of the invention.

This application is based on Japanese Patent Application No. 2005-182525, filed on Jun. 22, 2005, the entire contents of which are incorporated herein by reference.

INDUSTRIAL APPLICABILITY

The invention is suitable for the rear wheel arch of a white body.

The invention claimed is:

1. A roller hemming apparatus for winding an edge of a first plate around an edge of a second plate by bringing the second plate into contact with the first plate having an erected flange on the edge of the first plate and bending the erected flange by a roller while the first plate is received in a receiving die, wherein the receiving die includes a clamping mechanism, the clamping mechanism including a slider block and a clamping arm to selectively hold the first plate and the second plate to one another and being slidably engaged with the receiving die so as to permit movement of the receiving die with respect to the clamping mechanism while the clamping mechanism has retained at least the first plate between the slider block and the clamping arm of the clamping mechanism, and wherein the receiving die is a portable die used in a state where the clamping mechanism grasps the first plate.

2. The roller hemming apparatus according to claim 1, wherein the clamping mechanism is provided on the receiving die so as to be movable in a direction in which the receiving die is allowed to be separated from the first plate when the roller presses the erected flange.

3. The roller hemming apparatus according to claim 1, wherein the roller is adapted to move together with an auxiliary roller that specifies a movement locus, and a guide groove that specifies the movement locus of the auxiliary roller is provided in the receiving die.

4. The roller hemming apparatus according to claim 1, wherein the first plate is a rigid member in which a plurality of panels are connected and is hard to be bent.

5. A roller hemming method , comprising:

bringing a second plate into contact with a first plate having an erected flange at an edge of the first plate;

clamping at least the first plate with a clamping mechanism;

providing a receiving die for receiving the first plate and for slidable engagement with the clamping mechanism;

bending the erected flange by a roller while the first plate is received in the receiving die and clamped by the clamping mechanism so as to allow slidable movement of the receiving die with respect to the clamping mechanism; and winding the edge of the first plate around an edge of the second plate, wherein the hemming is performed while the first plate is brought in tightly contact with the receiving die at a portion of the roller, and the first plate is allowed to be separated from the receiving die at another portions.

* * * * *